US006601784B2

(12) United States Patent
Muller-Girard, Jr. et al.

(10) Patent No.: US 6,601,784 B2
(45) Date of Patent: Aug. 5, 2003

(54) FLEXURAL ELEMENT FOR POSITIONING AN ARMATURE IN A FUEL INJECTOR

(75) Inventors: Otto Muller-Girard, Jr., Rochester, NY (US); Karl Jacob Haltiner, Jr., Fairport, NY (US); Michael Schneider, Rochester, NY (US); Harrie William Bonnah, II, Pittsford, NY (US); Timothy P. Landschoot, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 71 days.

(21) Appl. No.: 09/853,893

(22) Filed: May 11, 2001

(65) Prior Publication Data

US 2002/0003176 A1 Jan. 10, 2002

Related U.S. Application Data

(63) Continuation-in-part of application No. 09/551,690, filed on Apr. 18, 2000, now abandoned.

(51) Int. Cl.[7] ..... B05B 1/30; F02M 51/00; F02M 61/00

(52) U.S. Cl. ..... 239/585.1; 239/585.3; 239/585.4; 239/585.5; 239/533.2

(58) Field of Search ..... 239/585.1, 585.3, 239/585.4, 585.5, 533.1, 533.2, 533.9, 533.13, 533.14, DIG. 12, 96; 251/127, 129.15, 129.18, 129.21

(56) References Cited

U.S. PATENT DOCUMENTS

| | | | | | |
|---|---|---|---|---|---|
| 4,393,994 | A | * | 7/1983 | Reick | 239/585 |
| 5,417,373 | A | * | 5/1995 | Facchin | 239/585.3 |
| 6,092,737 | A | * | 7/2000 | Bosch et al. | 239/96 |
| 6,161,783 | A | * | 12/2000 | Press | 239/585.3 |
| 6,318,646 | B1 | * | 11/2001 | Mattioli et al. | 239/585.1 |
| 6,364,222 | B1 | * | 4/2002 | Haltiner, Jr. et al. | 239/585.1 |

* cited by examiner

*Primary Examiner*—Davis Hwu
(74) *Attorney, Agent, or Firm*—Patrick M. Griffin

(57) ABSTRACT

A fuel injector includes a flexural element connected to a valve armature for restricting radial movement of the armature within a fuel passage. The flexural element is flat and exerts no force on the valve when it is closed but is flexed when the valve is opened and supplements the valve spring force during closing of the valve. The flexural element also is used to set the valve stroke length equal to the element's thickness. A flat tool presses a valve ball into the armature while the ball is seated on a valve seat until the flexural element engages a seat related surface. Engagement of the tool with the flexural element fixed to the armature assures that the flexural element is in an unloaded flat position when the valve is closed and establishes the valve stroke when the valve assembly and seat are installed in the injector body.

14 Claims, 3 Drawing Sheets

FLEXURAL ELEMENT FOR POSITIONING AN ARMATURE IN A FUEL INJECTOR

CROSS REFERENCE TO RELATED APPLICATION

This application is a continuation-in-part of U.S. application Ser. No. 09/551,690 filed Apr. 18, 2000, now abandoned.

TECHNICAL FIELD

The present invention relates generally to fuel injectors for use in an internal combustion engine and, more particularly, to a flexural element used for restricting radial movement of an armature within the passageway of the fuel injector.

BACKGROUND OF THE INVENTION

It is well known in the automotive engine art to provide solenoid actuated fuel injectors for controlling the injection of fuel into the cylinders of an internal combustion engine. Fuel injectors generally include a body having internal and external components which are assembled together to provide an internal fuel passage for fuel flow therein. An injection valve, including a magnetic armature, is actuated within the fuel passage to control fuel flow. In a plunger-type injector, the injector valve moves axially within the internal fuel passage. The inner walls of the fuel passage guide the axial movement of the injection valve such that there is minimal radial movement of the armature. Radial movement of the armature may cause sliding friction between the armature and other internal components of the injector which in turn decreases durability performance of the fuel injector. Therefore, it is desirable to provide a flexural element for restricting radial movement of the armature in an injector.

In addition, the stroke length also needs to be controlled in order to achieve suitable flow tolerance for the fuel injector. Typically, this has been accomplished by making the position of the pole piece and/or the valve seat adjustable relative to the other components of the fuel injector. However a method for accurately setting the valve stroke during assembly of the injector is considered desirable.

SUMMARY OF THE INVENTION

In accordance with the present invention, a fuel injector is provided for use in an internal combustion engine. The fuel injector includes an injector body having an axially extending fuel passage for fuel flow therein, a valve seat fixed at an outlet end of the fuel passage, and an injection valve with an armature movable in the passage for controlling fuel flow. The fuel injector further includes a flexural element connected to the armature for restricting radial movement of the armature within the fuel passage. In another aspect of the invention, the flexural element is used to set the stroke length of the fuel injector. The stroke length is set during the injector assembly process by inserting an inner pole piece into the injector body so that the lower ends of inner and outer poles are coplanar. A valve assembly is then preferably assembled having a valve element, or ball, a magnetic armature and a flexural element. A flat tool presses the ball into the armature while the ball is seated on the valve seat until the flexural element seats on a surface of the valve seat or an associated spacer ring. Engagement of the tool with resilient beams of the flexural element fixed to a flat upper surface of the armature assures that the flexural element is in an unloaded flat position when the valve is closed and the armature, when installed, is spaced from the poles by the thickness of the flexural element which establishes the valve stroke.

For a more complete understanding of the invention, its objects and advantages, refer to the following specification and to the accompanying drawings.

DESCRIPTION OF THE PREFERRED EMBODIMENT

Figure 1:
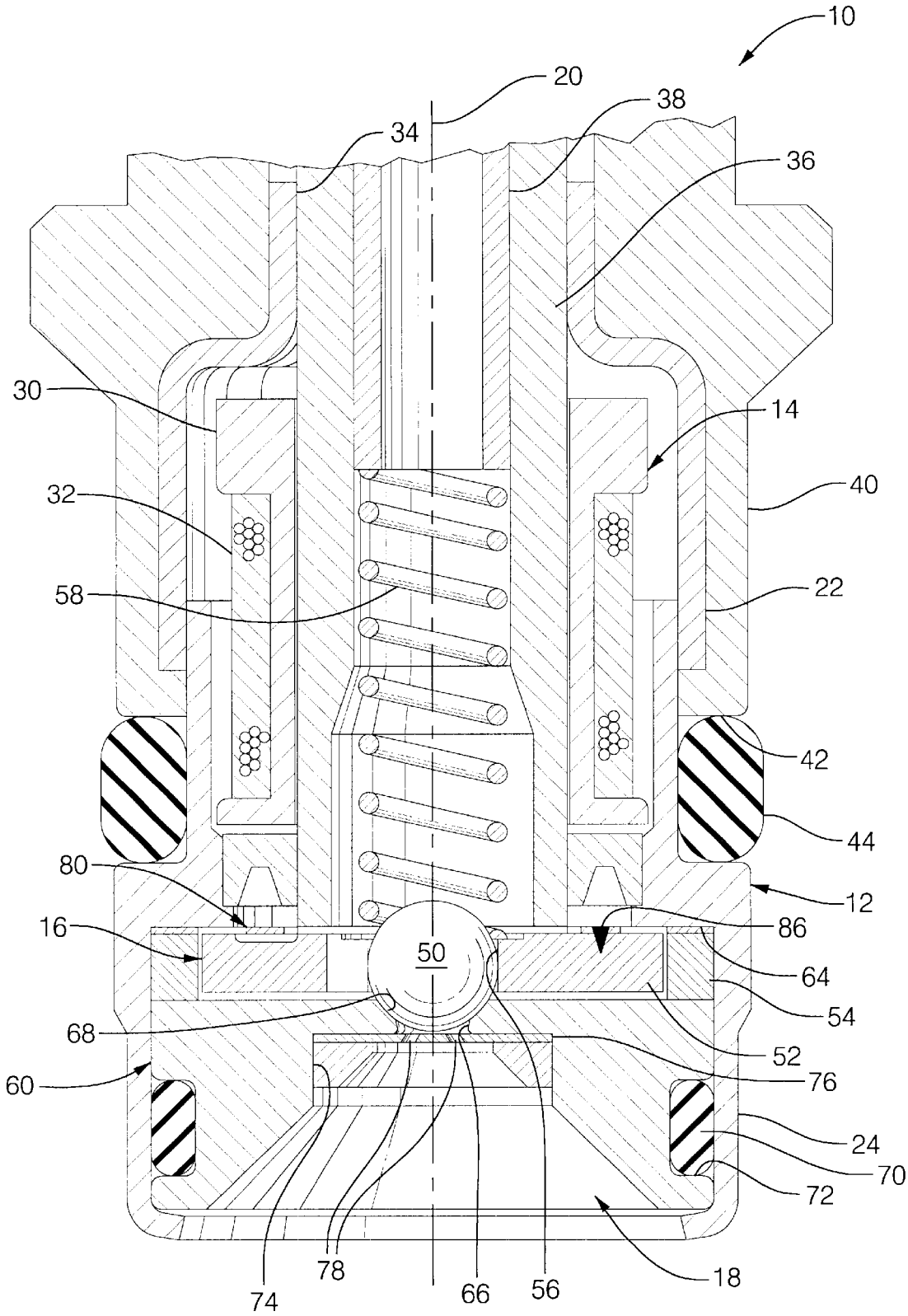
FIG. 1 is a partial side sectional view of a fuel injector embodying features of the present invention.

An electromagnetic fuel injector 10 embodying features of the present invention is depicted in FIG. 1. The fuel injector 10 generally includes an injector body 12, a solenoid actuator assembly 14, a valve assembly 16 and a nozzle assembly 18. While the following description is provided with reference to a disk type fuel injector, it is readily understood that the broader aspects of the present invention are applicable to other types of fuel injectors.

In the illustrated construction, the injector body 12 is a hollow, cylindrical configuration defining a central axis 20. The body 12 further includes an upper solenoid case portion 22 and an enlarged lower nozzle case portion 24.

The solenoid actuator assembly 14 is disposed within the enlarged upper solenoid case portion 22 of the injector body 12. The solenoid actuator assembly 14 includes a spool-like, tubular bobbin 30 that supports a wound wire solenoid coil 32. A magnetic pole piece 36 is slidably received in a central through bore 34 that extends coaxially through the bobbin 30. In addition, a calibration sleeve 38 is fixed within the pole piece 36. As will be more fully described below, energizing the solenoid coil 32 actuates the valve assembly 16.

A support casing 40 is formed as a tubular member that engages the upper solenoid case portion 22 of the injector body 12. The support casing 40, along with the outer surface of the pole piece 36 and the upper solenoid case portion 22 of the injector body 12, enclose the solenoid assembly 14. The support casing 40 also provides a lower end surface 42 for constraining an annular O-ring 44. The O-ring 44 may extend around the upper solenoid case portion 22 of the injector body 12. The O-ring 44 is also retained, in part, by the enlarged diameter of the lower nozzle portion 24 of the injector body 12.

The valve assembly 16 includes a valve element 50, optionally a ball, and a disc-shaped armature 52 that extends radially within the lower nozzle portion 24 of the injector body 12. The armature 52 is formed with outside diametral clearance so as to be freely axially movable within a spacer ring 54, which is shown as a separate member but could be made as part of the valve seat if desired. A spherical ball positioned within the armature 52 in a cylindrical socket 56 interrupted by fuel passage cutouts 57. The radius of the valve element 50 is selected for seating engagement with a valve seat 60. As will be apparent to one skilled in the art, other embodiments of the valve assembly are within the scope of the present invention.

The valve element 50 is normally biased into a closed position with the valve element 50 in seated engagement with the valve seat 60 by a biasing member, such as a coil spring 58. The coil spring 58 is positioned within the pole piece 36 between the calibration sleeve 38 and the armature 52 as shown in FIG. 1. In this way, the position of the calibration sleeve 38 within the pole piece 36 adjusts the spring force exerted on the armature 52.

Within the lower nozzle portion 24 of the injector body 12, the nozzle assembly 18 is retained therein by crimping over the outlet portions of the injector body 12. The nozzle assembly 18 includes the valve seat 60 and a spacer ring 62. The spacer ring 54 provides partial spacing for the armature 52 between an inwardly extending radial flange surface 64 of the lower nozzle portion 24 of the injector body 12 and a top surface of valve seat 60. Surface 64 also forms an outer pole for engagement by the armature while the pole piece 36 forms an inner pole. The valve seat 60 provides a central discharge opening 66 to allow fuel flow through the valve seat 60. The central discharge opening 66 is further defined as having a conical surface 68 which is engaged by the ball 50 of the valve in a closed position. An outer seal ring 70 is captured in an outer groove 72 of the valve seat 60, thereby preventing fuel from leaking around the valve seat and bypassing the discharge opening.

Furthermore, the central discharge opening 66 connects with a circular recess 74 on the underside of the valve seat 60. A fuel spray director plate 76 is press fitted or otherwise retained in the circular recess 74 of the valve seat 60. Fuel passing through the central discharge opening 66 is delivered to a director plate 76, where it is distributed across a plurality of fuel directing openings 78 extending therethrough. The fuel directing openings 78 are oriented to generate a desired spray configuration in the fuel discharged from the injector.

In operation, energizing of the solenoid coil 32 draws the armature 52 upward into engagement with the pole piece 36, and outer pole 64 thereby moving the ball 50 upward from the central discharge opening 66 in the valve seat 60. Fuel is then allowed to flow through the injector into an associated intake manifold or inlet port of an internal combustion engine (not shown). Upon de-energization of the solenoid coil 32, the coil spring 58 biases the armature 52 back towards the valve seat 60, thereby closing the injector.

Figure 2:
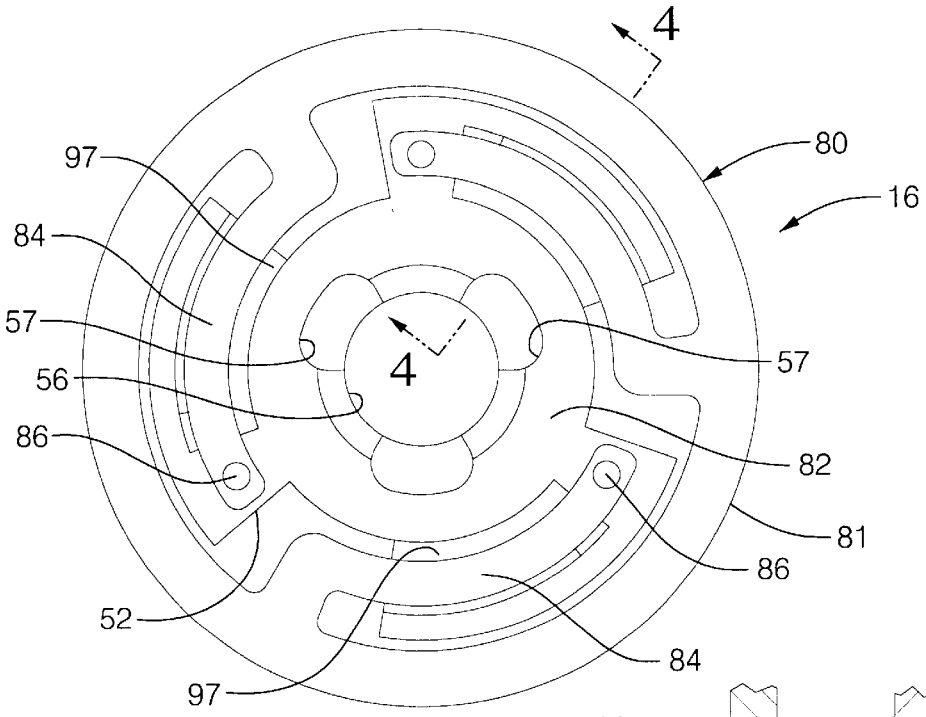
FIG. 2 is a cross-sectional view of the fuel injector which illustrates a first preferred embodiment of a flexural element in accordance with the present invention.

In accordance with the present invention, the armature 52 is connected with a flexural element 80 to form the valve assembly 16. Referring to FIG. 2, the flexural element 80 is a disc-shaped member having an outer ring 81 surrounding an open center 82 into which upper portions of the armature 52 are movable when the solenoid coil is energized. At least two resilient beams 84 extend inwardly into the center 82 and then circumferentially about the center 82. The armature 52 is coupled to the flexural element 80 at a distal end of each of the beams 84 by tack welds 86 or other suitable connector means.

Figure 3:
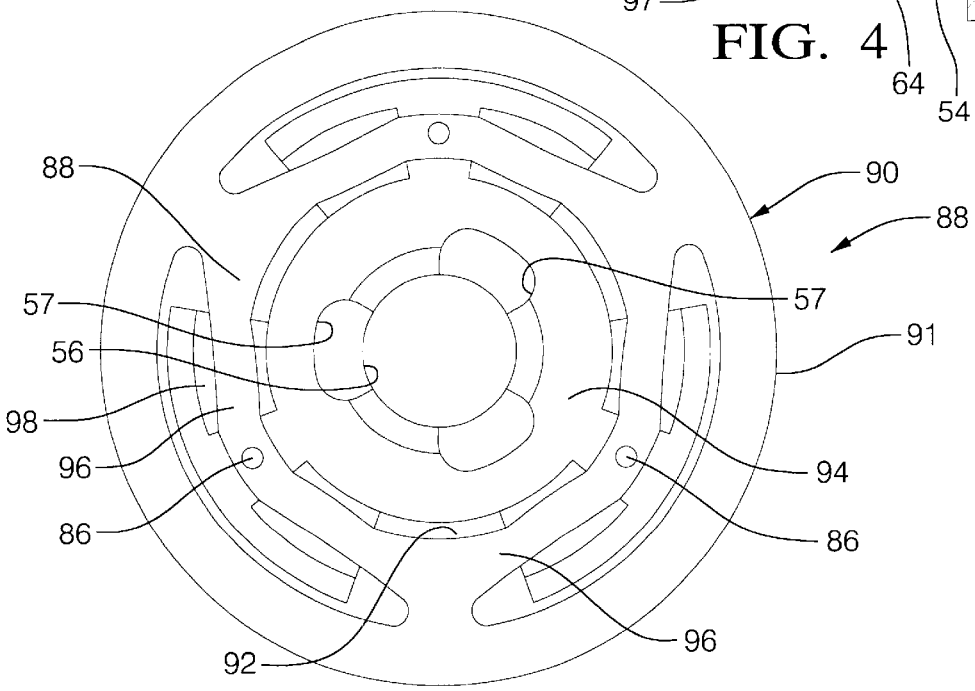
FIG. 3 is a cross-sectional view of the fuel injector which illustrates an alternative preferred embodiment of a flexural element in accordance with the present invention.

FIG. 3 illustrates an alternative embodiment of valve assembly 88 including a flexural element 90 wherein like numerals indicate like parts. The disc-shaped flexural element 90 includes an outer ring 91 surrounding an open center 92 into which upper portions of an armature 94 are movable when the solenoid coil is energized. At least two U-shaped resilient beams 96 extend inwardly into the center 92. In this case, the armature 94 is coupled by tack welds 86 to the flexural element 90 at the base of each of the U-shaped beams 94. Upper portions of the armature 96 also pass through the open center 92 to engage the poles 36, 64 when the coil 32 is energized. One skilled in the art will readily recognize that other configurations for a flexural element that would restrict the radial movement of the armature are within the scope of the present invention.

Figure 4:
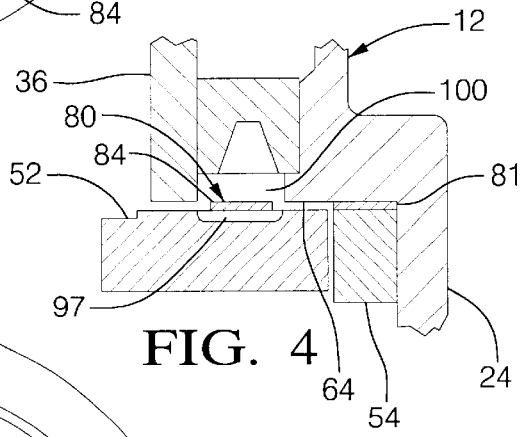
FIG. 4 is an enlarged side sectional view, taken along line 4—4 of FIG. 2, of the fuel injector of the present invention.

In the prior and subsequent discussion, references to the valve assembly 16 or its components, valve element 50, armature 52, and flexural element 80 and its features are equally applicable to valve assembly 88 and its corresponding components and features except as otherwise indicated. The flexural element 80 is secured within the body 12 by clamping the outer ring 81 of the flexural element 90 between a top surface of the spacer ring 54 and the inner flange surface 64 of the injector body 12. Pockets 97, 98, corresponding to the geometry of the flexural elements 80, 90, are located in the armatures 52, 96 adjacent to the location where the flexural elements 80, 90 are coupled to their armatures 52, 96. As the armature 52, lifts, the pockets 97, serve as clearances for the flexural element 80. Referring to FIG. 4, for example, an additional clearance 100 is provided between the inner pole piece 36 and the outer pole 64 to clear the portion of the flexural element 80 that is welded to the armature 52 so that the armature may move up to contact the poles 38 and 64.

In the valve closed position, the lower side of flexural element 80 lies coplanar with the top of the armature 52 and the spacer ring 62. The flexural element thus lies flat in an unstressed condition wherein it applies no load on the valve assembly 16 in either the opening or closing direction. All the preload on the valve 16 is therefore provided by the coil spring 58 which may be accurately determined or set after assembly of the main injector components by adjustment of the calibration sleeve 38 to obtain the desired preload prior to fixing the sleeve 38 within the pole piece 36. Having the flexural element at a neutral force position when the valve 16 is closed is desirable because the spring rate of the flexural element 80 is greater than that of the coil spring 58, so any load applied by the element 80 when the valve is closed would affect the opening time of the valve assembly 16, which is preferably maintained at a consistent value for all similar injectors.

When the injector is energized, the armature 52 is lifted upward from the valve seat 60. The attachment of the armature 52 to the flexural element 80 controls the trajectory of the armature 52 as it lifts up from the valve seat 60. In particular, the radial stiffness of the cantilever beams 84 (or the U-shaped beams 94) are such that the flexural element 80, allows for axial but minimal radial movement of the armature 52. In this way, the flexural element 80 prevents the armature 52 from rubbing against the spacer ring or other internal components of the injector and thus creates a bearing with no sliding friction.

In the open position, elastic energy is stored in the flexure element 80 and the coil spring 58. When the injector is de-energized, the elastic energy causes the armature 52 to travel towards the valve seat 60, thereby closing the injector and stopping the flow of fuel. Due to the high spring rate of the flexural element 80 relative to the coil spring 58, the armature 52 closes more quickly than it otherwise would in a conventional fuel injector. Thus, the flexural element 80 also guides the trajectory of the armature 52 as it returns to the closed position.

Figure 5:
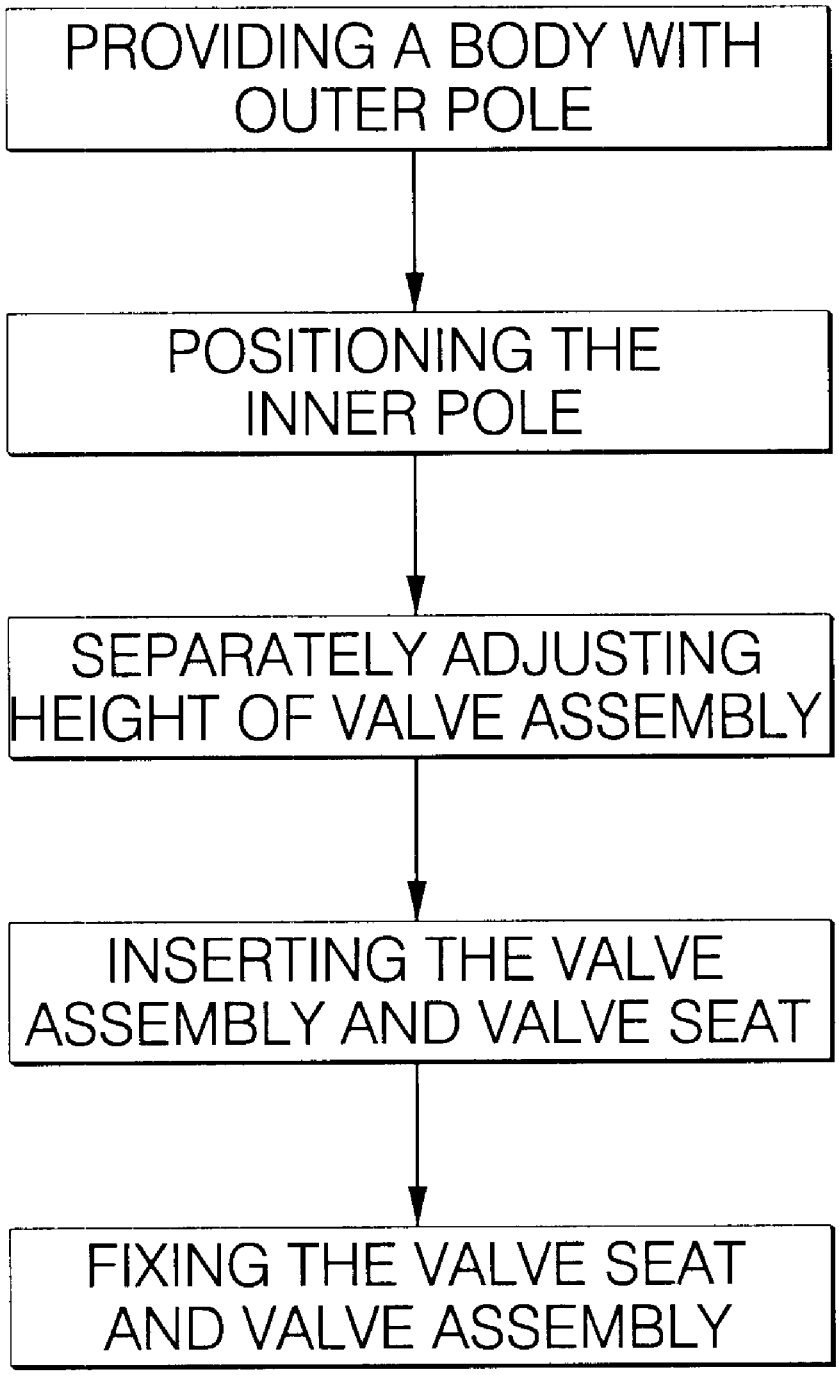
FIG. 5 is a flow chart illustrating a method for setting the stroke length during the assembly of the fuel injector in accordance with the present invention.

In another aspect of the present invention, the flexural element 80 is used to set the stroke length in the injector. A method for setting the stroke length during the injector assembly process is depicted in FIG. 5. The stroke length is generally set by inserting the pole piece 36 into the injector body 12 flush with the outer pole or flange surface 64. The valve assembly 16 is then inserted into the injector body 12, such that the flexural element 80 provides a spacing between the pole piece 36 and the armature 52. Accordingly, this spacing sets the stroke length for the injector.

More specifically, the bottom surface of the pole piece 36 is first positioned co-planar with the outer pole piece 64 of the injector. To do so, the inner pole piece 36 is fixed within the injector body 12. The inner and outer pole pieces 36 and 64 are then simultaneously machine finished so that the bottom surfaces of the poles are coplanar. Alternatively, a flat faced tool can be used to set the pole piece position. In this case, the tool is inserted into the lower portion of the injector body and the inner pole piece 36 is firmly pressed against the nominally flat surface of the tool prior to the pole 36 piece being fixed within the injector body 12.

In another alternative, the top surface of the valve seat 60 may be used to position the pole piece 36. The valve seat 60 is first inserted into the lower portion 24 of the injector body 12. Next, the inner pole piece 36 is firmly pressed against the flat top surface of the valve seat 60 prior to the pole piece being fixed within the injector body 12. The valve seat 60 can then be removed from the lower portion 24 of the injector body 12 so that the valve assembly 16 can be inserted into in the injector body 12.

Prior to inserting the valve assembly 16 into the injector body 12, the flexural element 80 is coupled to the armature 52 of the valve assembly 16. Preferably thereafter, the final position of the valve element or ball 50 in the armature 52 is established in any suitable manner. For example the ball may be pressed into position using a suitable fixture. However, tolerances in the components may cause unacceptable variations in the position of the armature 52, which should have its upper surface coplanar with that of the spacer 62 when the valve element 50 is seated in the valve seat 60.

To avoid such variations, a preferable method is to first press the ball 54 into the socket 56 at a lower position in the armature 52 than desired. The valve assembly is then placed on the conical surface 68 of the actual valve seat 60 to be used in the injector 10 and the spacer 62 is placed on the valve seat. A ball setting tool with a flat lower surface surrounding the ball is then pressed down against the flat flexural element 80, forcing the armature 52 down around the ball until the outer ring 81 of the flexural element engages the spacer ring 54. Since the cantilever beams 84 of the flexural element 80 engage the upper surface of the armature 52, and are in turn engaged by the ball setting tool, the armature is then spaced below the tool by the thickness of the flexural element 80. The armature 52 is then in position so that its upper surface is coplanar with the lower surface of the flexural element 80 and the upper surface of the spacer ring 54 when the valve assembly 16 is in the valve closed position. The ball may then be fixed in the armature in the set position by laser welding or other suitable processes.

The valve assembly 16 including the flexural element 80, the spacer ring 54 and the valve seat 60 are then placed into the lower portion 24 of the injector body 12 and a portion of the outer wall is crimped over in order to retain these elements in the injector body 12. It is envisioned that other techniques may be used to affix the valve seat 60 to the injector 12. The coil spring 58 biases the valve element 50 against the valve seat 60 in the valve closed position so that the armature is spaced from the magnetic poles 36, 64 by the thickness of the flexural element 80. Thus, the stroke of the injection valve assembly 16 for the armature to contact the poles 36, 64 is set equal to the thickness of the flexural element 80 by the setting of the valve ball or element 50 in the armature 52 with the flexural element 80 used as a spacer in the setting step.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A fuel injector for use in an internal combustion engine, comprising:

an injector body having a through extending fuel flow passage;

a magnetic pole fixed within the body and defining a portion of the passage;

a solenoid coil surrounding the pole;

a valve seat having a discharge opening and fixed at an outlet end of the passage; and a valve assembly including an injection valve biased toward the valve seat to close fuel flow through the passage, a magnetic armature movable with the valve and responsive to action of the coil for movement between open and closed positions and a flexural element connecting the armature with the injector body and restricting radial movement while allowing axial movement of the armature within the fuel passage, wherein the flexural element is unloaded when the valve is in the closed position and the flexural element is resiliently flexed and biases the valve in a closing direction when the valve is in the open position.

2. A fuel injector as in claim 1 and further including a spring continuously biasing the valve in a closing direction and applying a predetermined seating force on the valve when seated.

3. A fuel injector as in claim 2 wherein the flexural element has a greater spring rate than that of the spring, whereby the closing bias on the valve is increased by flexing of the flexural element when the valve is opened but the initial opening bias on the valve when closed is solely determined by the spring load.

4. A fuel injector for use in an internal combustion engine, comprising:

an injector body having a through extending fuel flow passage;

a magnetic pole fixed within the body and defining a portion of the passage;

a solenoid coil surrounding the pole;

a valve seat having a discharge opening and fixed at an outlet end of the passage; and a valve assembly including an injection valve biased toward the valve seat to close fuel flow through the passage, a magnetic armature movable with the valve and responsive to action of the coil for movement between open and closed positions and a flexural element connecting the armature with the injector body and restricting radial movement while allowing axial movement of the armature within the fuel passage, wherein the flexural element is unloaded when the valve is in the closed position and the flexural element is resiliently flexed and biases the valve in a closing direction when the valve is in the open position; and the flexural element is a disc-shaped ring having an open center and at least two resilient beams connected with the ring and extending radially into and angularly within the open center, the beams bending resiliently to allow axial motion of the armature.

5. A fuel injector as in claim 4 wherein the armature has a flat upper surface and the flexural element has a lower surface that is flat and coplanar with the armature upper surface when the valve is in the closed position.

6. A fuel injector as in claim 5 wherein the flexural element has a constant thickness and the armature is spaced from the magnetic pole a distance equal to said thickness when the valve is closed, and portions of the armature upper surface protrude into the open center of the flexural element to engage the pole when the valve is open.

7. A fuel injector as in claim 6 wherein said resilient beams are fixed to the upper surface of the armature at points of the beams distal from the connection of the beams with the ring of the flexural element and clearance is provided adjacent the pole for the connected points of the beams to rise beside the pole when the valve opens and the flat upper surface of the armature engages the pole.

8. A fuel injector as in claim 4 wherein said resilient beams comprise arms fixed at distal ends to the armature.

9. A fuel injector as in claim 4 wherein said resilient beams are U-shaped and connected at opposite ends to the ring and fixed intermediate their ends to the armature.

10. A fuel injector as in claim 4 wherein the injector body includes an upper cylindrical portion and an enlarged lower cylindrical portion, wherein the enlarged lower cylindrical portion is configured to house the armature and the valve seat.

11. A fuel injector as in claim 10 including a spacer ring seated on the valve seat and extending around the armature in the lower cylindrical portion of the body, wherein the ring of the flexural member is fixed between the spacer ring and the upper cylindrical portion of the body.

12. A method for setting a valve stroke in a fuel injector of an internal combustion engine, the fuel injector having an injector body carrying an inner pole at least partially defining an axially extending fuel passage therein, the method comprising the steps of:

providing the injector body with an upper cylindrical portion and an enlarged lower cylindrical portion connected by a radial flange surface forming an outer pole, wherein the enlarged lower cylindrical portion is configured to house a valve assembly and a valve seat;

positioning a lower surface of the inner pole coplanar with the radial flange surface of the outer pole;

inserting a valve assembly and a valve seat in the enlarged lower cylindrical portion of the body, the valve assembly having an armature with a flat upper surface, a valve element in the armature engagable with the valve seat and a disk shaped flexural element of constant thickness and including an outer ring with an open center and a plurality of resilient beams extending from the outer ring into and angularly about the center, the beams being connected to the flat upper surface of the armature at positions of the beams distal from their connections with the outer ring, the outer ring forming a spacer positioning the valve seat such that the valve stroke from the closed to the open position equals the thickness of the flexural element; and fixing the valve assembly and seat in the valve body.

13. A method as in claim 12 and further including:

separately providing a valve seat and a valve assembly including an armature having a flat upper surface and carrying a valve element pressed into the armature to a position below a final fixed position, and a flexural element formed as a constant thickness disk including an outer ring with an open center and a plurality of resilient beams extending from the outer ring into and angularly about the center, the beams being connected to the flat upper surface of the armature at positions of the beams distal from their connections with the outer ring;

providing a spacer ring extending up from a surface of the valve seat, the ring having a planar upper surface spaced a predetermined distance above a valve element seat in the valve seat, and placing the valve assembly within the spacer ring with the valve element seated on the valve element seat;

forcing a flat surface of a tool downward against the flexural element until the outer ring of the flexural element engages the upper surface of the spacer ring, whereby the flexural element is flat and engagement of the tool with the beams of the flexural element at their connection positions with the armature causes the flat upper surface of the armature to be spaced below the tool by the thickness of the flexural element and thereby positioned coplanar with the upper surface of the spacer ring; and using the same valve assembly and valve seat together with the spacer ring for fixing in the enlarged lower cylindrical portion of the body in the fixing step of claim 12.

14. A method as in claim 12 wherein the fixing step includes crimping over a lower portion of the injector body, thereby retaining the valve seat in the injector body.

* * * * *